United States Patent [19]

Inagaki et al.

[11] Patent Number: 4,569,899

[45] Date of Patent: Feb. 11, 1986

[54] PHOTOGRAPHIC ELEMENT FOR SILVER SALT DIFFUSION TRANSFER PROCESS

[75] Inventors: Yoshio Inagaki; Katsusuke Endo, both of Kanagawa, Japan

[73] Assignee: Fuji Photo Film Co., Ltd., Kanagawa, Japan

[21] Appl. No.: 678,941

[22] Filed: Dec. 6, 1984

[30] Foreign Application Priority Data

Dec. 7, 1983 [JP] Japan ..... 58-231087

[51] Int. Cl.[4] ..... G03C 5/54; G03C 1/35; G03C 5/46

[52] U.S. Cl. ..... 430/232; 430/233; 430/428; 430/611; 430/965

[58] Field of Search ..... 430/233, 232, 248–428, 430/611, 965

[56] References Cited

U.S. PATENT DOCUMENTS

| | | | |
|---|---|---|---|
| 3,252,799 | 5/1966 | Gotze et al. | 430/611 |
| 3,607,269 | 9/1971 | Young | 430/232 |
| 3,698,900 | 10/1972 | Johnson | 430/233 |
| 3,704,126 | 11/1972 | Land et al. | 430/233 |
| 3,833,372 | 9/1974 | Hayashi et al. | 430/248 |
| 3,963,495 | 6/1976 | Kato et al. | 430/233 |

*Primary Examiner*—Richard L. Schilling
*Attorney, Agent, or Firm*—Sughrue, Mion, Zinn, Macpeak, and Seas

[57] ABSTRACT

In a photographic element for a silver salt diffusion transfer process comprising a silver halide light-sensitive element, an image receiving element and a processing element, the improvement wherein the photographic element contains a compound represented by the following general formula (I) or (II)

(I)

(II)

wherein all the symbols are defined in the appended claims.

A photographic element for a silver salt diffusion transfer process containing the novel image stabilizing agent has good stability during storage thereof before development processing and provides stable silver images free from discoloration or fading.

29 Claims, No Drawings

PHOTOGRAPHIC ELEMENT FOR SILVER SALT DIFFUSION TRANSFER PROCESS

FIELD OF THE INVENTION

The present invention relates to a photographic element used for a silver salt diffusion transfer process.

BACKGROUND OF THE INVENTION

A diffusion transfer process utilizing silver salts such as silver halide, etc., has been known. In such a photographic process, it is known that positive silver images are obtained directly on an image receiving element by putting a light-sensitive element containing an exposed silver halide photographic emulsion on an image receiving element containing silver precipitants and processing in the presence of a developing agent by applying an alkaline processing solution containing a silver halide solvent between these two elements.

According to this process, unexposed silver halide emulsion in the light-sensitive element is dissolved by the silver halide solvent and enters the alkaline processing solution as a silver ion complex which is transferred to the image receiving element, wherein it precipitates as a silver image by the action of the silver precipitants, and, consequently, direct positive images are formed.

The image receiving element used in this process is generally produced by providing an image receiving layer which contains silver precipitants selected from metal sulfides such as nickel sulfide, silver sulfide or palladium sulfide, etc., and noble metal colloids such as gold, silver, palladium, etc., in an alkali permeable polymer binder selected from gelatin, carboxymethyl cellulose, hydroxyethyl cellulose, regenerated cellulose, polyvinyl alcohol, sodium alginate, starch, gum arabic and colloidal silica, etc., on a paper support such as baryta paper, polyethylene laminated paper, lacquer paper or synthetic paper, etc., or a film support such as an acetyl cellulose film, a polyethylene terephthalate film or a polystyrene film, etc.

In order to improve image receiving elements, numerous inventions have been made. Particularly, it has been known to use regenerated cellulose as a binder in the image receiving layer.

In U.S. Pat. No. 3,179,517, a process is described for producing image receiving elements which comprises forming a regenerated cellulose layer by hydrolyzing an acetyl cellulose film with an alkali, and thereafter immersing the regenerated cellulose layer in a solution of a gold salt and a solution of a reducing agent to cause a reaction in the layer, whereby a gold colloid silver precipitant is formed.

Japanese Patent Publication No. 32754/69 teaches producing an image receiving element by a process which comprises incorporating a silver precipitant in an alkali impermeable polymer substance by vacuum deposition, dissolving it in a solvent which dissolves the polymer substance, applying the resulting solution to a support, drying and hydrolyzing the surface layer of the formed polymer layer so as to render the same alkali permeable.

Japanese Patent Publication No. 43944/71 discloses producing an image receiving element by a process which comprises forming silver precipitants in a solution of acetyl cellulose, applying it to a support and hydrolyzing acetyl cellulose to convert it into regenerated cellulose.

Japanese Patent Publication No. 49411/76 discloses preparing an image receiving element by a process which comprises hydrolyzing a cellulose ester layer and incorporating silver precipitants in the hydrolyzed layer simultaneously with or after hydrolysis.

U.S. Pat. No. 4,163,816 discloses the production of an image receiving element by a process which comprises hydrolyzing acetyl cellulose in a solution with an acid to convert it into acetyl cellulose having a low degree of acetylation, and applying the solution to a support.

However, silver images formed on the image receiving elements obtained as described above have the faults in that they easily discolor or fade during preservation.

As a process for improving the above described faults, it is disclosed in Japanese Patent Publication No. 5392/71, U.S. Pat. No. 3,533,789 and British Pat. No. 1,164,642 that one can apply a water-soluble polymer solution containing an alkali neutralizing component to the surface of the resulting silver images. However, according to this process, the surface to which the aqueous solution of the polymer is applied requires a long time for complete drying. Therefore, it is impossible to arrange the prints in layers while drying, because the surface is sticky, and thus fingerprints and dust often adhere to the surface. Further, application of such a solution to silver images is troublesome.

Japanese Patent Publication No. 44418/81 discloses image receiving elements comprising a support, (I) a hydrolyzable cellulose ester, polyvinyl ester or polyvinyl acetal layer containing a diffusible compound capable of changing the properties of silver images, which becomes to have an alkali-permeable property by hydrolysis, provided on the support, and (II) a regenerated cellulose layer containing silver precipitants provided on the above described layer. As the diffusible compounds capable of changing the properties of silver images, organic mercapto compounds are disclosed. In this case, the diffusion transfer processing solution and the mercapto compound in layer (I) gradually diffuse into layer (II) and protect silver images formed in layer (II), whereby discoloration and fading can be prevented.

In order to completely exhibit the effect of preventing discoloration and fading, it is necessary that the mercapto compound has sufficient ability to prevent discoloration and fading and remains in layer (I) during storage of the undeveloped image receiving element or during diffusion transfer processing, but that it permeates into layer (II) from layer (I) after formation of silver images by diffusion transfer processing to protect the images formed on layer (II). If the mercapto compound diffuses into layer (II) from layer (I) before conclusion of diffusion transfer processing, development is restricted and the optical density of the transferred silver image on the image receiving material deteriorates on the whole. Further, if diffusion of the mercapto compound is retarded too much, discoloration or fading of images occurs before the silver images are protected by the mercapto compound.

However, the mercapto compounds described in Japanese Patent Publication No. 44418/81 have faults in that they have insufficient ability to prevent discoloration and fading and may cause discoloration or fading of images, and further they restrain development by diffusing into layer (II) from layer (I) during storage of the undeveloped image receiving element to deteriorate the optical density of the transferred silver images.

Japanese Patent Application (OPI) No. 120634/74 (the term "OPI" as used herein refers to a "published unexamined Japanese patent application") discloses image receiving elements which are produced using homopolymers, copolymers and graft polymers of a monoacrylate or monomethacrylate of a polyhydric alcohol as a polymer layer containing a compound which changes the properties of silver images.

However, the compounds disclosed in Japanese Patent Application (OPI) No. 120634/74 have faults similar to those of the compounds disclosed in Japanese Patent Publication No. 44418/81, i.e., they have insufficient ability to prevent discoloration or fading of images and they cause a decrease in the optical density of transferred silver images.

British Pat. No. 1,276,961 discloses that 2-mercapto-1,3,4-triazole derivatives can be used for obtaining stable silver images by a diffusion transfer process and U.S. Pat. No. 3,655,380 discloses that 5-seleno-1,2,3,4-tetrazole derivatives improve the tone of silver image obtained by a diffusion transfer process so as to be neutral gray and they give stable silver images.

However, these compounds have a fault in that the effect of stabilizing silver images obtained by a diffusion transfer process is insufficient to prevent discoloration or fading of images.

Therefore, it has been desired to provide compounds having a good effect of stabilizing silver images.

SUMMARY OF THE INVENTION

An object of the present invention is to provide a novel photographic element for a diffusion transfer process.

Another object of the present invention is to provide a novel image receiving element for a diffusion transfer process.

A further object of the present invention is to provide an image receiving element for a diffusion transfer process, the performance of which does not change during storage before development processing.

A further object of the present invention is to provide an image receiving element for forming stable silver images by a diffusion transfer process.

A still further object of the present invention is to provide a novel image stabilizer.

Other objects of the present invention will be apparent from the following detailed description and examples.

The above described objects of the present invention are attained by a photographic element for a silver salt diffusion transfer process comprising a silver halide light-sensitive element, an image receiving element and a processing element, wherein the photographic element contains a compound represented by the following general formula (I) or (II).

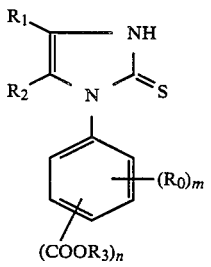

(I)

-continued

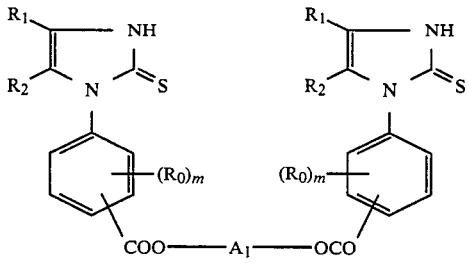

(II)

wherein the $R_0$ groups, which may be the same or different, each represents a hydrogen atom, a halogen atom (for example, F, Cl, Br, etc.), an alkyl group having preferably from 1 to 14 carbon atoms (for example, a methyl group, an ethyl group, etc.), a substituted alkyl group having preferably from 1 to 14 carbon atoms in the alkyl moiety (wherein the substituent includes, for example, an alkoxy group having 10 or less carbon atoms, a halogen atom, a hydroxyl group, a carbamoyl group, a sulfamoyl group, a sulfonamido group, a carbonamido group and an alkylthio group), a substituted or unsubstituted cycloalkyl group having preferably from 3 to 14 carbon atoms (wherein the substituent includes, for example, an alkoxy group having 10 or less carbon atoms, a halogen atom, a hydroxyl group, a carbamoyl group, a sulfamoyl group, a sulfonamido group, a carbonamido group and an alkylthio group), an alkoxy group having preferably from 1 to 14 carbon atoms, a substituted alkoxy group having preferably from 1 to 14 carbon atoms (wherein the substituent includes, for example, an alkoxy group having 10 or less carbon atoms, a halogen atom, a hydroxyl group, a carbamoyl group, a sulfamoyl group, a sulfonamido group, a carbonamido group and an alkylthio group) (for example, a methoxy group, an ethoxy group, etc.), a substituted or unsubstituted alkylsulfonyl group having preferably from 1 to 14 carbon atoms (wherein the substituent includes, for example, an alkoxy group having 10 or less carbon atoms, a halogen atom, a hydroxyl group, a carbamoyl group, a sulfamoyl group, a sulfonamido group, a carbonamido group and an alkylthio group), a substituted or unsubstituted arylsulfonyl group having preferably from 6 to 14 carbon atoms (wherein the substituent includes, for example, an alkoxy group having 10 or less carbon atoms, a halogen atom, a hydroxyl group, a carbamoyl group, a sulfamoyl group, a sulfonamido group, a carbonamido group and an alkylthio group), a sulfamoyl group (the nitrogen atom of the sulfamoyl group may be substituted with an alkyl group having 14 or less carbon atoms, a substituted alkyl group, a cycloalkyl group, a substituted cycloalkyl group, an aryl group, a substituted aryl group, or a substituted or unsubstituted 5- to 7-membered heterocyclic group containing one or more of at least one of a nitrogen atom, an oxygen atom and a sulfur atom, or two substituents on the nitrogen atom may form a ring (e.g., morpholine, phrrolidine or piperidine) by linking together, an alkyl or arylsulfonamido group (wherein the alkyl moiety or the aryl moiety may have a substituent (e.g., an alkoxy group having 10 or less carbon atoms, a halogen atom, a hydroxyl group, a carbamoyl group, a sulfamoyl group, a sulfonamido group, a carbonamido group or an alkylthio group), and the nitrogen atom of the sulfonamido group may be substituted with an alkyl group having 14 or less carbon atoms, a substituted alkyl group (wherein the substituent includes, for example, an alkoxy group having 10 or less carbon atoms, a halogen atom, a hydroxyl group, a carbamoyl group, a sulfamoyl group, a sulfonamido group, a carbonamido group and an alkylthio group), a cycloalkyl group, a substituted cycloalkyl group (wherein the substituent includes, for example, an alkoxy group having 10 or less carbon atoms, a halogen atom, a hydroxyl group, a carbamoyl group, a sulfamoyl group, a sulfonamido group, a carbonamido group and an alkylthio group), an aryl group, a substituted aryl group (wherein the substituent includes, for example, an alkoxy group having 10 or less carbon atoms, a halogen atom, a hydroxyl group, a carbamoyl group, a sulfamoyl group, a sulfonamido group, a carbonamido group and an alkylthio group), and a substituted or unsubstituted 5- to 7-membered heterocyclic group containing one or more of at least one of a nitrogen atom, an oxygen atom and a sulfur atom (wherein the substituent includes, for example, an alkyl group having 10 or less carbon atoms, an alkoxy group having 10 or less carbon atoms, a halogen atom, a hydroxyl group, a carbamoyl group, a sulfamoyl group, a sulfonamido group, a carbonamido group and an alkylthio group)), a carbamoyl group (wherein the nitrogen atom of the carbamoyl group may be substituted with an alkyl group having 14 or less carbon atoms, a substituted alkyl group, a cycloalkyl group, a substituted cycloalkyl group, an aryl group, a substituted aryl group, or a substituted or unsubstituted 5- to 7-membered heterocyclic group containing one or more of at least one of a nitrogen atom, an oxygen atom and a sulfur atom, or two substituents on the nitrogen atom may form a ring by linking together), a carbonamido group (wherein the nitrogen atom of the carbonamido group may be substituted with an alkyl group having 14 or less carbon atoms, a substituted alkyl group (wherein the substituent includes, for example, an alkoxy group having 10 or less carbon atoms, a halogen atom, a hydroxyl group, a carbamoyl group, a sulfamoyl group, a sulfonamido group, a carbonamido group and an alkylthio group), a cycloalkyl group, a substituted cycloalkyl group (wherein the substituent includes, for example, an alkoxy group having 10 or less carbon atoms, a halogen atom, a hydroxyl group, a carbamoyl group, a sulfamoyl group, a sulfonamido group, a carbonamido group and an alkylthio group), an aryl group, a substituted aryl group (wherein the substituent includes, for example, an alkoxy group having 10 or less carbon atoms, a halogen atom, a hydroxyl group, a carbamoyl group, a sulfamoyl group, a sulfonamido group, a carbonamido group and an alkylthio group), or a substituted or unsubstituted 5- to 7-membered heterocyclic group containing one or more of at least one of a nitrogen atom, an oxygen atom and a sulfur atom (wherein the substituent includes, for example, an alkyl group having 10 or less carbon atoms, an alkoxy group having 10 or less carbon atoms, a halogen atom, a hydroxyl group, a carbamoyl group, a sulfamoyl group, a sulfonamido group, a carbonamido group and an alkylthio group)), a heterocyclic group, preferably, a substituted or unsubstituted 5- to 7-membered heterocyclic group containing one or more of at least one of a nitrogen atom, an oxygen atom and a sulfur atom (wherein the substituent includes, for example, an alkyl group having 10 or less carbon atoms, an alkoxy group having 10 or less carbon atoms, a halogen atom, a hydroxyl group, a carbamoyl group, a sulfamoyl group, a sulfonamido group, a carbonamido group and an alkylthio group), a substituted or unsubstituted aryl group having preferably 14 or less carbon atoms (wherein the substituent includes, for example, an alkoxy group having 10 or less carbon atoms, a halogen atom, a hydroxyl group, a carbamoyl group, a sulfamoyl group, a sulfonamido group, a carbonamido group and an alkylthio group), an acyl group having preferably 14 or less carbon atoms, a substituted or unsubstituted alkoxycarbonyl group having preferably from 2 to 14 carbon atoms (wherein the substituent includes, for example, an alkoxy group having 10 or less carbon atoms, a halogen atom, a hydroxyl group, a carbamoyl group, a sulfamoyl group, a sulfonamido group, a carbonamido group and an alkylthio group), a substituted or unsubstituted acyloxy group having preferably from 2 to 14 carbon atoms (wherein the substituent includes, for example, an alkoxy group having 10 or less carbon atoms, a halogen atom, a hydroxyl group, a carbamoyl group, a sulfamoyl group, a sulfonamido group, a carbonamido group and an alkylthio group), a substituted or unsubstituted alkylthio group having preferably from 1 to 14 carbon atoms (wherein the substituent includes, for example, an alkyl group having 10 or less carbon atoms, an alkoxy group having 10 or less carbon atoms, a halogen atom, a hydroxyl group, a carbamoyl group, a sulfamoyl group, a sulfonamido group and a carbonamido group), a substituted or unsubstituted arylthio group having preferably from 6 to 14 carbon atoms (wherein the substituent includes, for example, an alkoxy group having 10 or less carbon atoms, a halogen atom, a hydroxyl group, a carbamoyl group, a sulfamoyl group, a sulfonamido group, a carbonamido group and an alkylthio group), a primary amino group or a salt thereof, a secondary or tertiary amino group substituted with an alkyl group having from 1 to 14 carbon atoms or an aryl group having from 6 to 14 carbon atoms or a salt thereof (wherein the alkyl group and the aryl group may have a substituent of, for example, an alkoxy group having 10 or less carbon atoms, a halogen atom, a hydroxyl group, a carbamoyl group, a sulfamoyl group, a sulfonamido group, a carbonamido group or an alkylthio gorup), a nitro group, a hydroxyl group, a carboxyl group, a sulfonic acid group or a cyano group; and $R_1$ and $R_2$ each represents a hydrogen atom, a halogen atom (for example, a chlorine atom, a bromine atom, etc.), an alkyl group having preferably from 1 to 14 carbon atoms (for example, a methyl group, an ethyl group, etc.), a substituted alkyl group having preferably from 1 to 14 carbon atoms in the alkyl moiety (for example, a methoxyethyl group, an ethoxyethyl group, a chloroethyl group, a benzyl group, etc.) or an aryl group (for example, a phenyl group, a naphthyl group, etc.).

$R_3$ represents an alkyl group having preferably from 1 to 30 carbon atoms (for example, a butyl group, a hexyl group, an octyl group, etc.), a substituted alkyl group having preferably from 1 to 30 carbon atoms in the alkyl moiety (for example, a methoxy group, a benzyl group, a hydroxyethyl group, etc.), an aryl group (for example, a phenyl group, a naphthyl group, etc.), a substituted aryl group, or a heterocyclic group, preferably, a substituted or unsubstituted 5- to 7-membered heterocyclic group having one or more of at least one of a nitrogen atom, an oxygen atom and a sulfur atom.

Examples of substituents in the substituted alkyl group represented by $R_1$ or $R_2$ include an alkoxy group (for example, a methoxy group, an ethoxy group, etc.), a halogen atom (for example, Cl, Br, etc.) and a phenyl group, etc.

Examples of substituents in the substituted alkyl group represented by $R_3$ include an alkoxy group (for example, a methoxy group, an ethoxy group, etc.), a halogen atom (for example, Cl, Br, etc.), a phenyl group and a hydroxyl group, etc.

Examples of substituents in the substituted aryl group represented by $R_3$ include an alkyl group (for example, a methyl group, an ethyl group, etc.), an alkoxy group (for example, a methoxy group, an ethoxy group, etc.) and a halogen atom (for example, Cl, Br, etc.), etc.

Examples of substituents in the substituted 5- to 7-membered heterocyclic group represented by $R_3$ include an alkyl group having 10 or less carbon atoms, an alkoxy group having 10 or less carbon atoms, a halogen atom, a hydroxyl group, a carbamoyl group, a sulfamoyl group, a sulfonamido group and an alkylthio group.

$A_1$ represents a divalent group. Examples of preferable divalent groups include the following.

$-(CH_2)_{n1}O-(CH_2)_{n1}$ wherein $n_1$ is an integer of 1 to 6, $-(CH_2)_{n2}$ wherein $n_2$ is an integer of 2 to 12,

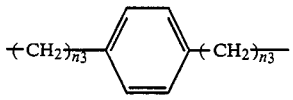

wherein $n_3$ is 0 or an integer of 1 to 4, and $-(CH_2)_{n4}A_2-(CH_2)_{n4}$ wherein $n_4$ is an integer of 1 to 6 and $A_2$ is

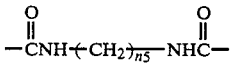

(wherein $n_5$ is an integer of 2 to 10).

m represents an integer of 1 to 4, and n represents an integer of 1 or 2.

DETAILED DESCRIPTION OF THE INVENTION

The alkyl groups and the alkyl moieties represented by $R_1$ may be straight chain or branched chain.

In general formula (I), it is preferred that $R_1$ and $R_2$ each represents a hydrogen atom, m is 0, n is 1 and $R_3$ represents an alkyl group having from 4 to 30 carbon atoms or a substituted alkyl group having from 4 to 30 carbon atoms in the alkyl moiety.

In general formula (II), it is preferred that $R_1$ and $R_2$ each represents a hydrogen atom, m is 0 and $A_1$ represents an alkylene group having from 2 to 8 carbon atoms. It is particularly preferred that $A_1$ represents an ethylene group, a propylene group, a butylene group, a pentylene group, a heptylene group or an octylene group.

Preferably, the above-described objects are attained by incorporating the compound represented by the above described general formula (I) or (II) in a photographic element for a silver salt diffusion transfer process, where the diffusion transfer processing is carried out by putting an imagewise exposed silver halide light-sensitive element on an image receiving element containing silver precipitants and spreading an alkaline processing composition between them.

More preferred embodiments are those where the compound(s) represented by general formula (I) or (II) is contained in the above described image receiving element.

As the photographic element for a silver salt diffusion transfer process containing the compound represented by general formula (I) or (II), it is preferred to use those where transfer silver images are obtained by putting a light-sensitive material (where a light-sensitive element containing a silver halide photographic emulsion is applied to a support) on an image receiving material (where an image receiving element containing silver precipitants is applied to another support), and spreading an alkaline processing composition as a processing element between the above described light-sensitive material and the image receiving material.

It is preferred that the support for supporting the above described image receiving element be a polyethylene laminated paper.

The image receiving element is preferred to have an acid polymer layer which reduces the pH of the image receiving element after development processing and a neutralization timing layer which controls the timing of neutralization.

The neutralization timing layer is preferred to contain acetyl cellulose.

The image receiving element is preferred to have a layer construction wherein an acid polymer layer, a neutralization timing layer and an image receiving layer containing silver precipitants are applied to s support in this order. In the above described layer construction, it is particularly preferred to provide a hydrophilic polymer layer between the neutralization timing layer and the image receiving layer.

It is preferred that the compound represented by general formula (I) or (II) is added to both an image receiving layer and a layer other than the image receiving layer in the image receiving element.

The image receiving element is preferred to contain the compound represented by general formula (I) or (II) and a water-soluble heavy metal salt (preferably chloroaurate). The mol ratio of the water-soluble heavy metal salt to the compound represented by general formula (I) or (II) is about 1:1.

In the following, examples of effective compounds represented by general formulae (I) and (II) are specifically described, but the present invention is not to be construed as being limited to these compounds.

1.

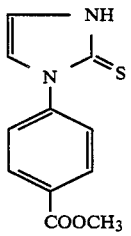

2.

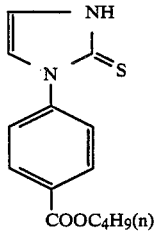

-continued
3.
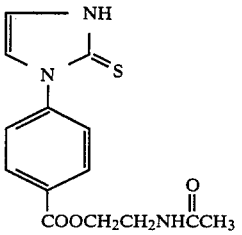
4.
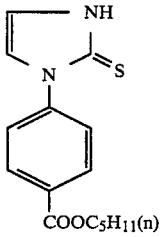
5.
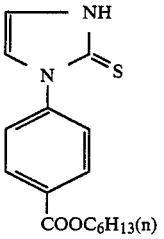
6.
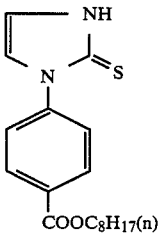
7.
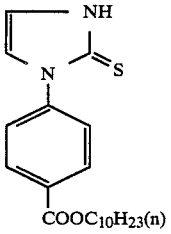
8.
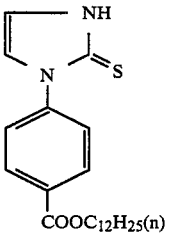
-continued
9.
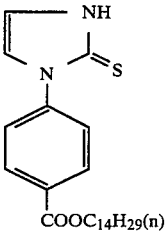
10.
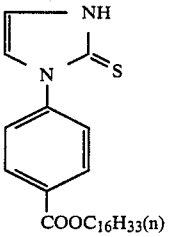
11.
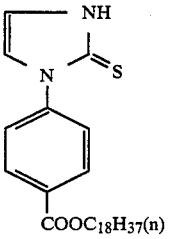
12.
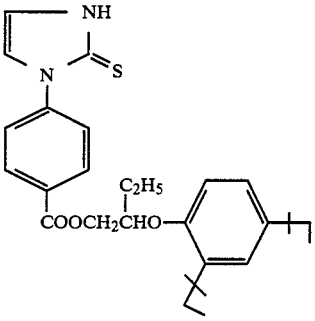
13.
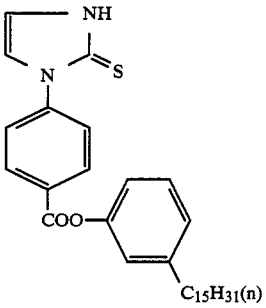
14.
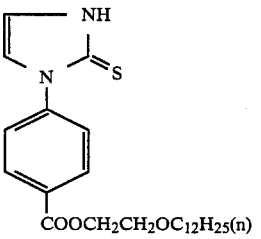

-continued
15.
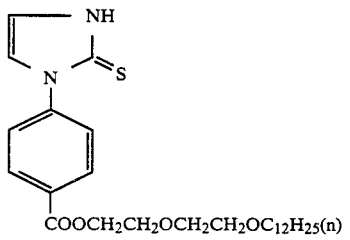
16.
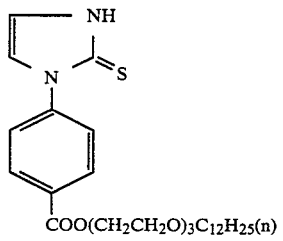
17.
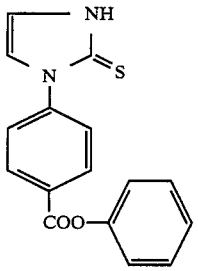
18.
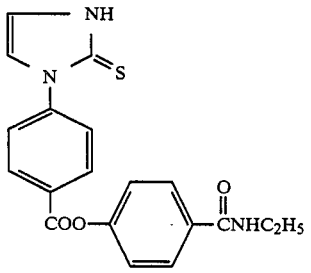
19.
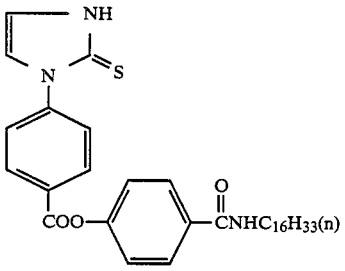
20.
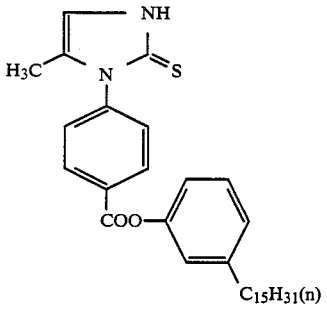
-continued
21.
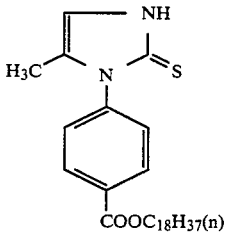
22.
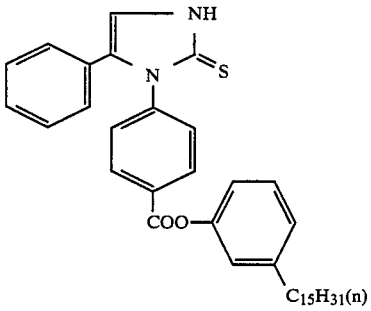
23.
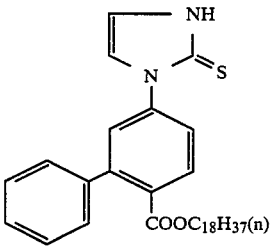
24.
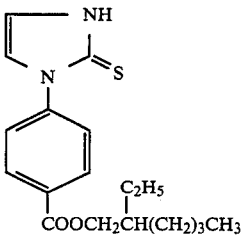
25.
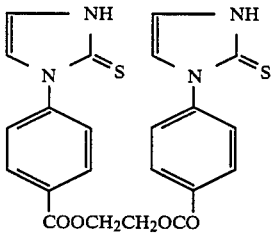
26.
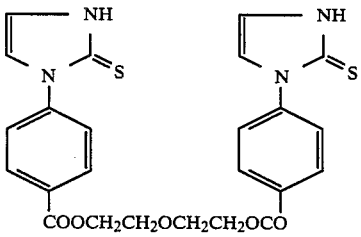

-continued

27.

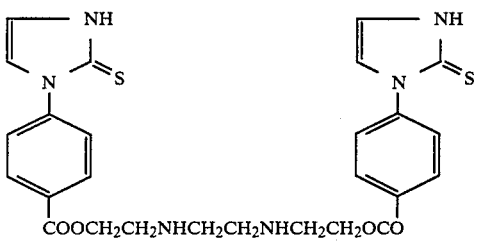

28.

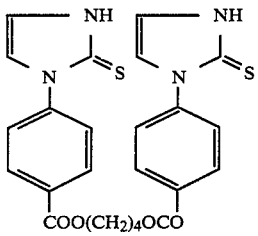

29.

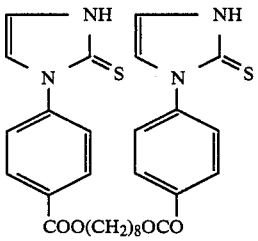

30.

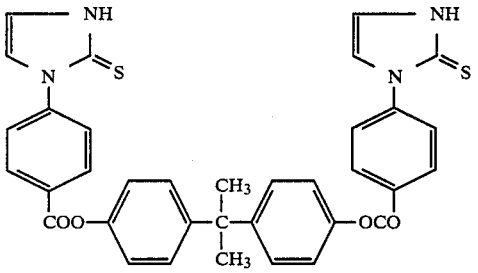

31.

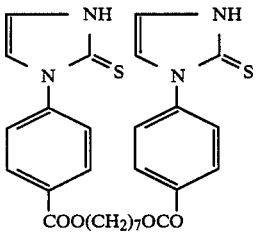

-continued

32.

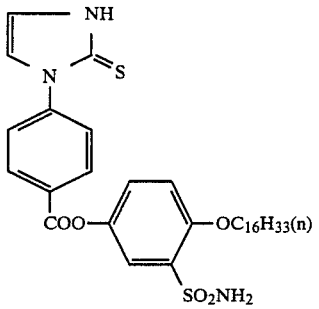

The compounds used according to the present invention can be synthesized by conventional processes.

More specifically, the compounds used in the present invention (D) are obtained by reacting a carboxylic acid represented by formula (A) with a chlorinating agent such as thionyl chloride, phosphorus oxychloride, etc., in a solvent such as acetonitrile, dimethylformamide, dimethylacetamide, N-methylpyrrolidone, etc., to convert it into the corresponding carboxylic acid chloride represented by formula (B), and thereafter reacting the resulting product with an alcohol or an alcoholate of an alkali metal. Alternatively, the compounds used in the present invention can be obtained by reacting a carboxylic acid represented by formula (A) with an acid chloride, for example, a chloroformic acid ester such as isobutyl chloroformate, ethyl chloroformate, methyl chloroformate, etc., or pivaloyl chloride, in a solvent such as N,N-dimethylformamide, N,N-dimethylacetamide, N-methylpyrrolidone, etc., to convert it into the corresponding mixed acid anhydride represented by formula (C), and reacting the resulting product with an alcohol or an alcoholate of alkali metal.

Furthermore, the compounds used in the present invention (D) can be easily synthesized by subjecting the compounds obtained by the above described processes and an alcohol to a known transesterification to exchange the ester moiety ($R_3$).

These processes are illustrated below. All moieties are the same as in general formulae (I) and (II) unless otherwise indicated. R″ represents an alkyl group (for example, a methyl group, an ethyl group or an isobutyl group).

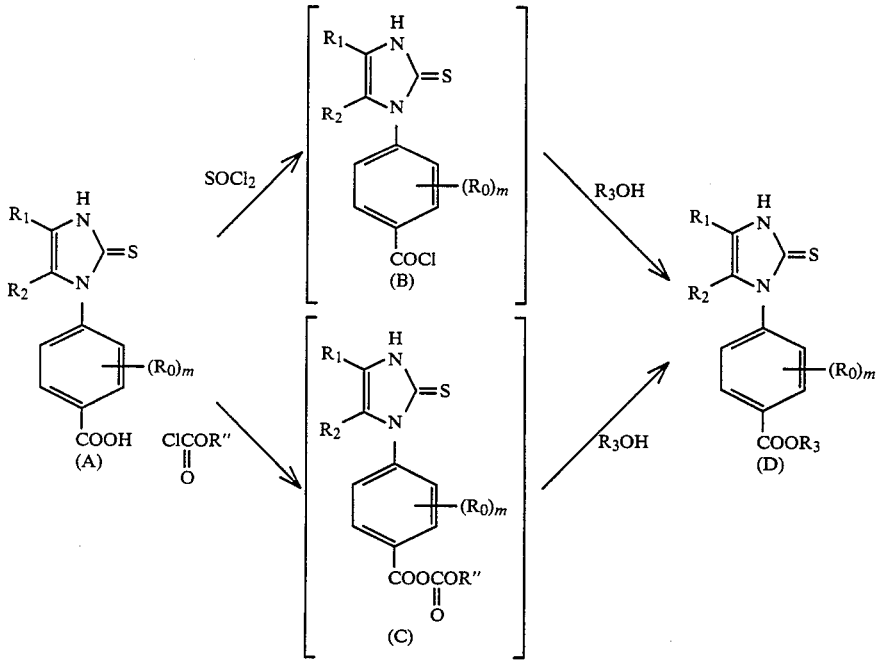

If diols such as alkylene diols, etc., or alcoholates thereof are used as the alcohol or alcoholate thereof in an amount of ½ molar equivalents of the carboxylic acid (A) or esters thereof, compounds represented by formula (E) are obtained.

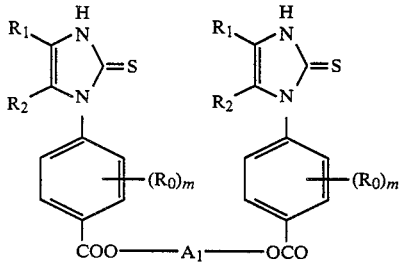

Specific examples of these synthesis reactions are described hereinafter. Conventional synthesis operations in these kinds of ester synthesis processes and analogous synthesis examples are described, for example, in *Organic Functional Group Preparations,* by S. R. Sandler and W. Karo, published by Academic Press, 1968, pages 245 to 265 and *Peptide Gosei,* by Nobuo Izumiya, Tetsuo Kato, Motonori Ohno and Toshiko Aoyagi, published by Maruzen Co., 1975, pages 115 to 153; such synthesis processes can be utilized for synthesizing the compounds according to the present invention.

Further, carboxylic acids represented by formula (A) can be synthesized from p-aminobenzoic acid esters (for example, ethyl esters) by the following procedure. Namely, a p-aminobenzoic acid ester is reacted with carbon disulfide and triethylamine in a solvent such as pyridine to produce the corresponding dithiocarbamic acid triethylammonium salt. It is then allowed to react with ethyl chloroformate or methyl chloroformate, followed by heating to obtain the corresponding isothiocyanate. To the isothiocyanate, aminoacetaldehyde diethyl acetal is added, and the mixed product is heated in the presence of an acid such as sulfuric acid, whereby the ester is hydrolyzed simultaneously with ring closing to obtain a carboxylic acid represented by formula (A). Substituted derivatives of the compounds represented by formula (A) can be synthesized by the same process as described above.

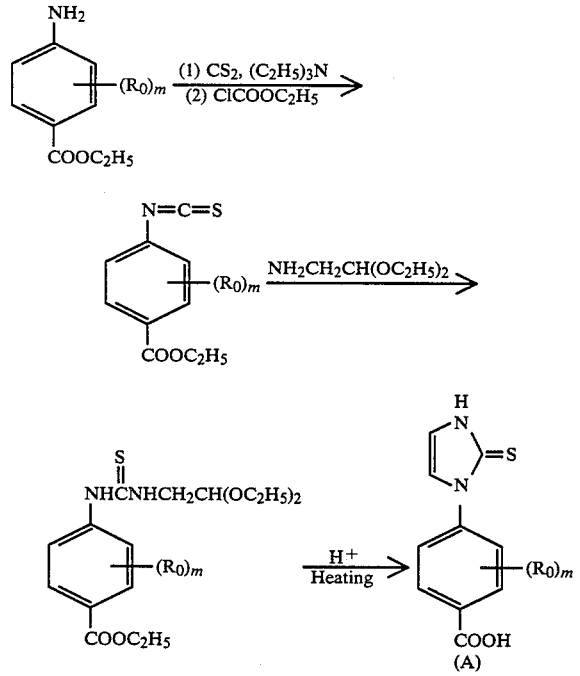

The isothiocyanates used (for example, p-carboethoxyphenylisothiocyanate) can be synthesized according to the process described in *Organic Functional Group Prep-*

*arations,* by S. R. Sandler and W. Karo, published by Academic Press, 1968, pages 312 to 315.

In the following, processes for synthesizing compounds according to the present invention are illustrated by synthesis examples; compounds which are not shown in the synthesis examples can be synthesized according to the following synthesis examples by simple modification thereof.

All percentages are by weight unless otherwise indicated.

SYNTHESIS EXAMPLE 1

Synthesis of Compound 1

(1) Synthesis of N-(4-carboethoxyphenyl)-N'-(2,2-diethoxyethyl)thiourea:

20 g of 4-carboethoxyphenylisothiocyanate was dissolved in 50 ml of carbon tetrachloride, and 13 g of aminoacetaldehyde diethyl acetal was added dropwise to the resulting solution over 5 minutes. The mixture was then stirred at room temperature for 1 hour. 50 ml of carbon tetrachloride was added to the reaction mixture, and the separated crystals were collected by filtration, washed with 50 ml of carbon tetrachloride and dried.

Yield: 27.5 g and 80.9 mol%.

(2) Synthesis of carboxylic acid (A) [1-(4-carboxyphenyl)-2,3-dihydroimidazole-2-thione]:

To 80 g of N-(4-carboethoxyphenyl)-N'-(2,2-diethoxyethyl)thiourea obtained in (1), 400 ml of 30% sulfuric acid was added and the mixture was refluxed on an oil bath for 1 hour. After the reaction mixture was cooled to room temperature, 600 ml of water was added and the mixture was cooled with ice. The separated crystals were collected by filtration, washed with 200 ml of water, 100 ml of isopropyl alcohol and 100 ml of hexane in turn, and dried.

Yield: 48 g and 92.8 mol%.

(3) Synthesis of Compound 1:

6.6 g of 1-(4-carboxyphenyl)-2,3-dihydroimidazole-2-thione obtained in (2) was dissolved in 45 ml of N,N-dimethylacetamide, and the resulting solution was cooled to a liquid temperature of 0° C. or below. To the resulting solution, 3.96 ml of isobutyl chloroformate was added while keeping the liquid temperature below 0° C. After 4.2 ml of triethylamine was added dropwise while keeping the liquid temperature below 0° C., the mixture was stirred for 30 minutes while keeping the liquid temperature below 0° C. While maintaining the liquid temperature below 0° C., 30 ml of methanol and then 6 ml of a 28% methanol solution of sodium methoxide were dropwise added, and the mixture was stirred for 30 minutes while keeping the liquid temperature below 0° C. After stirring further for 2 hours at room temperature, the reaction mixture was poured into 500 ml of water, the precipitate thus-formed was collected by filtration, washed with water and dried to obtain Compound 1.

Yield: 3.8 g and 54.1 mol%.

Melting Point: 203° to 205° C.

SYNTHESIS EXAMPLE 2

Synthesis of Compound 9

To 3.3 g of Compound 1 were added 9.0 g of n-tetradecyl alcohol and 0.08 ml of tetrabutoxy titanium and the mixture was heated on an oil bath at 140° C. under reduced pressure for 1 hour with stirring. After cooling the reaction mixture to room temperature, 100 ml of ethanol was added thereto and the crystals thus-formed were collected by filtration, washed with 100 ml of hexane and recrystallized from 300 ml of acetonitrile.

Yield: 3.6 g and 61.7 mol%.

Melting Point: 118° to 120° C.

SYNTHESIS EXAMPLE 3

Synthesis of Compound 10

To 3.3 g of Compound 1 were added 10.2 g of n-hexadecyl alcohol and 0.08 ml of tetrabutoxy titanium and the mixture was heated on an oil bath at 140° C. under reduced pressure for 1 hour with stirring. After cooling the reaction mixture to room temperature, 150 ml of ethanol was added thereto and the crystals thus-formed were collected by filtration, washed with 100 ml of hexane and recrystallized from 400 ml of acetonitrile.

Yield: 4.6 g and 73.9 mol%.

Melting Point: 120° to 121° C.

SYNTHESIS EXAMPLE 4

Synthesis of Compound 11

To 3.3 g of Compound 1 were added 11.4 g of n-octadecyl alcohol and 0.08 ml of tetrabutoxy titanium and the mixture was heated on an oil bath at 140° C. under reduced pressure for 1 hour with stirring. After cooling the reaction mixture to room temperature, 150 ml of ethanol was added thereto and the crystals thus-formed were collected by filtration, washed with 100 ml of hexane and recrystallized from 600 ml of acetonitrile.

Yield: 5.3 g and 80.1 mol%.

Melting Point: 121° to 122° C.

SYNTHESIS EXAMPLE 5

Synthesis of Compound 12

To 3.3 g of Compound 1 were added 12.9 g of 2-(2,4-di-tert-amylphenoxy)butyl alcohol and 0.08 ml of tetrabutoxy titanium and the mixture was heated on an oil bath at 140° C. under reduced pressure for 5 hours with stirring. After cooling the reaction mixture to room temperature, hexane was added thereto and the crystals thus-formed were collected by filtration and recrystallized from 100 ml of hexane containing a small amount of ethanol.

Yield: 5.2 g and 73.0 mol%.

Melting Point: 178° to 179° C.

SYNTHESIS EXAMPLE 6

Synthesis of Compound 13

6.6 g of 1-(4-carboxyphenyl)-2,3-dihydroimidazole-2-thione was dissolved in 45 ml of N,N-dimethylacetamide, and the resulting solution was cooled to a liquid temperature of 0° C. or below. To the resulting solution, 3.9 ml of isobutyl chloroformate was added while keeping the liquid temperature below 0° C. After 4.2 ml of triethylamine was added dropwise while keeping the liquid temperature below 0° C., the mixture was stirred for 30 minutes while keeping the liquid temperature below 0° C., and then, while maintaining the liquid temperature below 0° C., 60 ml of N,N-dimethylacetamide containing 10.3 g of potassium 3-pentadecylphenolate dissolved therein was added dropwise, the reaction solution was stirred for 30 minutes while keeping the liquid temperature below 0° C. and then for hours at room temperature and poured into 2 liters water. The mixture was extracted with ethyl acet the extract was washed with water and dried with a drous sodium sulfate. The ethyl acetate was distilled off and the residue was recrystallized from ethanol and then from acetonitrile. The crystals thus-obtained were purified by silica gel column chromatography (spreading agent: a solvent mixture of chloroform and ethyl acetate in a ratio of 7:3 by volume).

Yield: 1.3 g and 8.6 mol%.

Melting Point: 160° to 161° C.

SYNTHESIS EXAMPLE 7

Synthesis of Compound 14

To 2.1 g of Compound 1 were added 4.1 g of 2-dodecyloxy ethanol and 0.05 ml of tetrabutoxy titanium and the mixture was heated on an oil bath at 140° C. under reduced pressure for 5 hours with stirring. After cooling the reaction mixture to room temperature, hexane was added thereto and the crystals thus-formed were collected by filtration and recrystallized twice from a solvent mixture of ethanol and hexane and then twice from a solvent mixture of ethyl acetate and hexane.

Yield: 1.5 g and 38.5 mol%.

Melting Point: 89° to 91° C.

The image stabilizing agent represented by the above described general formula (I) or (II) can be incorporated in any of the light-sensitive element, the image receiving element, and the processing element. Further, it may be incorporated in two or more of these elements. However, it is particularly preferably incorporated in the image receiving element.

The diffusion transfer process is well known in the art. Details thereof are described, e.g., in A. Rott and E. Weyde, *Photographic Silver Diffusion Transfer Processes,* Focal Press, London, 1972; C. B. Neblette, *Handbook of Photography and Reprography,* 7th Ed., Van Nostrand Reinhold (1977), Chapter 12, One-Step Photography; and Haist, *Modern Photographic Processing,* Vol. 2, Chapter 8, Diffusion Transfer, etc.

In the diffusion transfer process, many kinds of photographic materials can be used. Namely, it is known that transfer silver images can be obtained by laying a light-sensitive material which comprises a light-sensitive element containing a silver halide photographic emulsion applied to a support on an image receiving material which comprises an image receiving element containing silver precipitants applied to another support, and spreading an alkaline processing composition as a processing element, for example, an alkaline processing composition having a high or low viscosity which contains a developing agent and a solvent for silver halide between the above described two elements. This type of photographic material is advantageously used for practicing the present invention.

In another known photographic material, a light-sensitive element and an image receiving element are applied to a support in layers by which positive images can be observed through negative images utilizing the high covering power of the positive images, as described in U.S. Pat. No. 2,861,885. As a further known photographic material, there is one which has the same construction as described above, wherein only positive images are obtained by washing off the layer of the light-sensitive material after carrying out diffusion transfer processing.

Further, as another known photographic material, there is one which comprises a silver halide light-sensitive layer, a layer containing a light reflecting substance such as titanium white, and an image receiving layer containing silver precipitants applied to a support in turn, wherein positive images are obtained by processing.

Moreover, a photographic material is known having an integral type structure wherein a light-sensitive element and an image receiving element are provided on the same support which can be used without separating the image receiving element from the light-sensitive element after carrying out diffusion transfer processing.

Further, additive color images can be produced by forming silver transfer images according to the present invention, and these images have a superposed connection with an additive color screen. In such a material, additive color images can be produced by placing an additive color screen between a transparent support and the above described image receiving layer and exposing the silver halide emulsion to light through the screen.

These various kinds of photographic materials have been described in detail in the above described literature.

Although the present invention is applicable to film units of all the above described types, the case where a light-sensitive element and an image receiving element are applied to different supports, respectively, is illustrated in detail hereinafter.

The light-sensitive layer used in the present invention may contain one or more kinds of silver halide. Examples of such silver halides include silver chloride, silver bromide, silver iodide and mixtures thereof such as silver chlorobromide, silver chloroiodobromide and silver iodobromide. They may be incorporated by dispersing them in suitable protective colloid substances, such as gelatin, agar, albumen, casein, collodion, cellulose type materials, for example, carboxymethyl cellulose, vinyl polymers, for example, polyvinyl alcohol, or linear polyamides, for example, polyhexamethylene adipamide. Emulsions suitable for such use can be prepared by processes as described in *Chimie et Physique Photographique,* written by P. Glafkides (published by Paul Montel Co., 1967), *Photographic Emulsion Chemistry,* written by G. F. Duffin (published by The Focal Press, 1966), and *Making and Coating Photographic Emulsions,* written by V. L. Zelikman et al. (published by The Focal Press, 1964), etc. Namely, any of an acid process, a neutral process, an ammonia process, etc., may be used. Further, as a type of reacting soluble silver salts with soluble halogen salts, any of a single jet mixing process, a double jet mixing process or a combination thereof may be used.

A process of forming grains in the presence of excess silver ion (the so-called reverse mixing process) can also be used. As a type of double jet mixing process, a process which comprises keeping the pAg of a liquid phase where silver halide is formed at a constant value, namely, the so-called controlled double jet process, can also be used.

As silver halide emulsions, though so-called primitive emulsions which have not been subjected to chemical sensitization can be used, they are generally chemically sensitized. In order to carry out chemical sensitization, it is possible to use processes as described in the above described literature written by Glafkides, Duffin, and Zelikman et al., and *Grundlagen der Photographischen Prozesse mit Silberhalogenidemulsioen,* edited by H. Frieser (Akademische Verlagsgesellschaft, 1968).

The silver halide emulsion can be subjected, if desired, to spectral sensitization or supersensitization by using one or more of cyanine dyes such as cyanine, merocyanine or carbocyanine dyes, or combinations of cyanine dyes and styryl dyes. These color sensitization techniques are well known and they have been described, for example, in U.S. Pat. Nos. 2,493,748, 2,519,001, 2,977,229, 3,480,434, 3,672,897, 3,703,377, 2,688,545, 2,912,329, 3,397,060, 3,615,635 and 3,628,964, British Pat. Nos. 1,195,302, 1,242,588 and 1,293,862, West German Patent Application (OLS) Nos. 2,030,326 and 2,121,780, Japanese Patent Publication Nos. 4936/68, 14030/69 and 10773/68, U.S. Pat. Nos. 3,511,664, 3,522,052, 3,527,641, 3,615,613, 3,615,632, 3,617,295, 3,635,721 and 3,694,217, and British Pat. Nos. 1,137,580, 1,216,203, etc. Selection thereof can be suitably carried out according to the purpose and use of the light-sensitive materials, such as the wavelength range to be sensitized or sensitivity, etc.

Silver halide emulsions used in the present invention may contain antifoggants and stabilizers, e.g., such compounds as are described in *Product Licensing Index,* Vol. 92, page 107, the paragraph entitled "Antifoggants and stabilizers".

The silver halide emulsions may contain developing agents, e.g., such as those described in *Product Licensing Index,* Vol. 92, pages 107 and 108, the paragraph entitled "Developing agents".

The silver halide(s) can be dispersed in colloids capable of being hardened by various organic or inorganic hardeners, e.g., the hardeners described in *Product Licensing Index,* Vol. 92, page 108, the paragraph entitled "Hardeners" can be used.

The silver halide emulsions may contain coating aids, e.g., such as those described in *Product Licensing Index,* Vol. 92, page 108, the paragraph entitled "Coating aids".

The silver halide photographic emulsions may contain antistatic agents, plasticizers, fluorescent whitening agents, air fog preventing agents and the like.

In the silver halide emulsions used in the present invention, vehicles as described in *Product Licensing Index,* Vol. 92, page 108, the paragraph entitled "Vehicles" (December 1971) can be used.

The silver halide emulsions are applied to supports together with, if desired, other photographic layers. Application can be carried out by processes as described in *Product Licensing Index,* Vol. 92, page 109, the paragraph entitled "Coating Procedures". Further, as supports, those described in *Product Licensing Index,* Vol. 92, page 108, the paragraph entitled "Supports" can be used.

For the purpose of increasing sensitivity, improving contrast or accelerating development, the photographic emulsions of the present invention may contain, for example, polyalkylene oxide or derivatives thereof such as ethers, esters or amines thereof, thioether compounds, thiomorpholines, quaternary ammonium salt compounds, urethane derivatives, urea derivatives, imidazole derivatives, 3-pyrazolidones, etc. For example, it is possible to use the compounds as described in U.S. Pat. Nos. 2,400,532, 2,423,549, 2,716,062, 3,617,280, 3,772,021, 3,808,003, etc.

In the light-sensitive materials produced according to the present invention, the photographic emulsion layer and other hydrophilic colloid layers may contain water-soluble dyes as filter dyes or for the purpose of preventing irradiation or other effects. Examples of such dyes include oxonol dyes, hemioxonol dyes, styryl dyes, merocyanine dyes, cyanine dyes and azo dyes. Among others, merocyanine dyes, oxonol dyes and hemioxonol dyes are useful. The dyes may be mordanted by cationic polymers such as dialkylaminoalkyl acrylate, etc., in a specific layer.

In the light-sensitive materials produced according to the present invention, when dyes or ultraviolet ray absorbing agents are contained in hydrophilic colloid layer(s), they may be mordanted by cationic polymers. For example, it is possible to use the polymers as described in British Pat. No. 685,475, U.S. Pat. Nos. 2,675,316, 2,839,401, 2,882,156, 3,048,487, 3,184,309 and 3,445,231, West German Patent Application (OLS) No. 1,914,362, and Japanese Patent Application (OPI) Nos. 47624/75, 71332/75, etc.

As the processing composition of the present invention, various processing compositions can be used, but the processing compositions are preferred to contain a developing agent, a solvent for silver halide and an alkali agent. However, the developing agent and/or the solvent for silver halide may be incorporated in the light-sensitive element and/or the image receiving element according to the particular purpose.

Examples of suitable silver halide developing agents include benzene derivatives substituted with at least two hydroxyl and/or amino groups at the ortho- or para-positions of the benzene ring, such as hydroquinone, amidol, metol, glycine, p-aminophenol and pyrogallol; and hydroxylamines, particularly, primary or secondary aliphatic or aromatic N-substituted or $\beta$-hydroxylamines which are soluble in aqueous alkaline materials, such as hydroxylamine, N-methylhydroxylamine or N-ethylhydroxylamine and those described in U.S. Pat. No. 2,857,276 Land et al. and N-alkoxyalkyl substituted hydroxylamines described in U.S. Pat. No. 3,293,034 Miltongreen et al.

Further, hydroxylamine derivatives having a tetrahydrofurfuryl group as described in Japanese Patent Application (OPI) No. 88521/74 can be used.

Further, aminoreductones as described in West German Patent Application (OLS) Nos. 2,009,054, 2,009,055 and 2,009,078 and heterocyclic aminoreductones as described in U.S. Pat. No. 4,128,425 can be used.

Moreover, it is possible to use tetraalkyl reductic acids as described in U.S. Pat. No. 3,615,440.

Further, it is possible to use auxiliary developing agents such as phenidone compounds, p-aminophenol compounds or ascorbic acid together with the above described developing agents.

Examples of suitable solvents for silver halide include conventional fixing agents such as sodium thiosulfate, sodium thiocyanate, ammonium thiosulfate or the compounds as described in U.S. Pat. No. 2,543,181; and compounds composed of a combination of a cyclic imide and a nitrogen base such as those composed of a combination of a barbiturate or uracil and ammonia or amine, or those composed of a combination as described in U.S. Pat. No. 2,857,274 Land et al.

Further, 1,1-bissulfonylalkanes and derivatives thereof can be used as the solvent for silver halide in the present invention.

The processing compositions may contain alkali materials and, preferably, alkali metal hydroxides such as sodium hydroxide or potassium hydroxide. In the case that the processing composition is applied as a thin layer between the light-sensitive element and the image receiving element superposed on each other, it is preferred that the processing composition contain polymer film forming agents, thickening agents or viscosity increasing agents. Hydroxyethyl cellulose and sodium carboxymethyl cellulose are particularly useful for such a purpose, and are incorporated in the processing compositions in a concentration effective to give a suitable viscosity according to known principles of the diffusion transfer process. The processing compositions may further contain other assistants known in silver salt diffusion transfer processes, for example, antifoggants, toning agents, stabilizers, etc.

The image receiving element used in the present invention is composed of an image receiving layer containing a silver precipitant in a hydrophilic polymer binder and a support for supporting the layer, as described above.

As useful hydrophilic polymers, a number of materials have been known, but regenerated cellulose is particularly preferred, as described above. In order to produce the image receiving element, it is possible to utilize a process which comprises incorporating a silver precipitant in a cellulose ester, for example, cellulose diacetate, by deposition, applying the cellulose ester to a support and hydrolyzing it with an alkali material(s), a process which comprises forming a silver precipitant by reacting, for example, silver nitrate with sodium sulfide in a solution of cellulose ester, in situ, applying the solution to a support and hydrolyzing it with an alkali material(s), a process which comprises hydrolyzing a cellulose ester layer previously applied to a support with an alkali material(s), and putting a silver precipitant into the hydrolyzed layer at the same time, and a process which comprises hydrolyzing a cellulose ester layer with an alkali material(s) to form regenerated cellulose and forming a silver precipitant in the hydrolyzed layer by reacting, for example, chloroauric acid with a reducing agent.

Further, if desired or necessary, it is possible to leave a layer of cellulose ester which is not hydrolyzed or partially hydrolyzed cellulose ester under a layer of hydrolyzed cellulose ester containing a silver precipitant, and it is possible to provide a polymer layer such as a polyvinyl butyral layer under a layer of hydrolyzed cellulose ester. The polymer layer is known to serve as a waterproofing layer.

Further, if desired or necessary, another hydrophilic polymer layer may be provided between the layer of hydrolyzed cellulose ester containing a silver precipitant and the waterproofing layer composed of a cellulose ester, partially hydrolyzed cellulose ester or polyvinyl butyral. Examples of polymers useful for the hydrophilic polymer layer include gelatin, gelatin derivatives (for example, phthalated gelatin, etc.), saccharides (for example, starch, galactomannan, gum arabic, hydroxyethyl cellulose, methyl cellulose, carboxymethyl cellulose, pullulan, hydroxypropyl cellulose, etc.), and hydrophilic synthetic polymers (for example, polyacrylamide, polymethyl acrylamide, poly-N-vinylpyrrolidone, 2-hydroxyethyl methacrylate, etc.), etc.

Further, if desired or necessary, an alkali neutralizing agent layer may be provided. In this alkali neutralizing agent layer, polymer acids as described in Japanese Patent Publication No. 33697/73 can be used.

Further, in order to improve the releasing property of processing solutions so that the processing solutions can easily separate from the surface of the image receiving layer and remain on the surface of the light-sensitive layer when the separation of the image receiving layer from the light-sensitive layer is carried out, it is effective to apply a layer of a hydrophilic polymer, such as carboxymethyl cellulose, gelatin, gum arabic, a dimethylhydantoin-formaldehyde condensation product or cellulose acetate hydrogen phthalate, etc., on the image receiving layer.

Moreover, it is possible to add fluorescent whitening agents in order to improve whiteness, and it is effective to add plasticizers in order to further soften the polymer applied layer, if desired.

In the case of incorporating the image stabilizing agent of the present invention represented by general formula (I) or (II) in the image receiving element, it is possible to add the image stabilizing agent to one or more of the above described layers.

In particularly preferred embodiments, it has been found that it is advantageous to add the image stabilizing agent of the present invention to the layer containing a silver precipitant, e.g., the layer of cellulose ester which is not subjected to hydrolysis under the image receiving layer, as described in U.S. Pat. No. 3,607,269, or to add the image stabilizing agent of the present invention to the layer of a hydrophilic high polymer such as 2-hydroxyethyl methacrylate provided under the hydrolyzed celulose ester layer, as described in Japanese Patent Application (OPI) No. 120634/74. The amount thereof added to the layer of cellulose ester which is not subjected to hydrolysis, the layer of a hydrophilic high polymer or other layers is preferred to be in a range of from about $1\times10^{-6}$ to $1{,}000\times10^{-6}$ mol/m$^2$. A particularly preferred amount is in the range of from $10\times10^{-6}$ to $500\times10^{-6}$ mol/m$^2$.

In order to incorporate the image stabilizing agent of the present invention in the photographic element, it is possible to apply a solution which is prepared by dissolving the image stabilizing agent in water or a low boiling point organic solvent such as methanol, ethanol, propanol, acetone, methyl ethyl ketone, cyclohexanone, cyclopentanone, petroleum ether, benzene, toluene, ether, tetrahydrofuran, dioxane, dimethylformamide, ethyl acetate, butyl acetate, etc., together with the desired polymer(s), or it is possible to immerse the photographic element in a solution of the image stabilizing agent after preparation of the photographic element.

Further, the image stabilizing agent of the present invention can be added to the processing composition, whereby it diffuses into the image receiving element during processing to provide an image stabilizing effect.

Further, the image stabilizing agent used in the present invention may be used together with known image stabilizing agents. It is also effective to use the image stabilizing agent of the present invention together with heavy metal salts, for example, salts of noble metal such as gold, palladium, platinum, silver, etc., or metal salts such as a zinc, nickel salt, etc. It is found that particularly useful heavy metal salts are soluble gold salts such as chloroauric acid.

Examples of suitable silver precipitants include heavy metal such as iron, lead, zinc, nickel, cadmium, tin, chromium, copper, cobalt, and particularly, noble metals such as gold, silver, platinum, or palladium. Other examples of available silver precipitants include sulfides and selenides of heavy metals, and particularly sulfides of mercury, copper, aluminum, zinc, cadmium, cobalt, nickel, silver, palladium, lead, antimony, bismuth, cerium and magnesium, and selenides of lead, zinc, antimony and nickel. The functions of materials such as silver precipitants in the silver transfer process have been described, e.g., in U.S. Pat. No. 2,774,667 Land et al.

The silver precipitant is present in a very small amount, for example, about $1\times10^{-5}$ to $25\times10^{-5}$ mol/m$^2$ in the image receiving element, as in known techniques. Generally, as little as possible is used, because excess silver precipitates or undesirable background density is formed in highlight areas if the amount is large. Mixed silver precipitants may be used. It can be said that the image receiving layer is substantially colorless and substantially transparent so far as the presence of the precipitant is concerned.

The photographic element for a silver salt diffusion transfer process containing the image stabilizing agent(s) represented by general formula (I) or (II) according to the present invention is advantageous in that the performance thereof does not change during storage before development processing and thus it provides sufficiently high $D_{max}$ and stable silver images upon development processing; further, the change in $D_{max}$ is small.

When the image stabilizing agent represented by general formula (I) or (II) is ballasted, particularly high $D_{max}$ is obtained after storage of the photographic element. This is believed to be due to the fact that the image stabilizing agent hardly diffuses in the photographic element during storage before development processing.

The image stabilizing agent represented by general formula (I) or (II) according to the present invention provides excellent images, particularly having a high $D_{max}$, since it does not restrain development even when it is present in a position which is nearer the processing solution than the silver precipitant containing layer of the image receiving sheet.

Further, the image stabilizing agent according to the present invention can be incorporated directly into a hydrophilic colloid layer containing silver precipitants since development restraint due to the image stabilizing agent hardly occurs.

In the following, the present invention is illustrated in greater detail with reference to examples and comparative examples, but the present invention should not be construed as being limited to these examples. All percentages are by weight unless otherwise indicated.

EXAMPLE 1

(1) Preparation of Image Receiving Sheets

To a polyethylene laminated paper where the polyethylene has been subjected to a corona discharge treatment (area weight 150 g/m$^2$, thickness of polyethylene 20 μm), a solution prepared by dissolving 8 g of cellulose diacetate (degree of acetylation: 53%) and 12 g of methyl vinyl ether in a mixture of 200 ml of acetone and 20 ml of methanol was applied and dried. The amount of the polymers applied was 10 g/m$^2$.

To the resulting layer, a solution prepared by dissolving 20 g of cellulose diacetate in a mixture of 200 ml of acetone and 20 ml of methanol was applied and dried. The dry thickness of the cellulose diacetate layer was 5 μm.

To the resulting cellulose diacetate layer, a 1% aqueous solution of polyacrylamide was applied. The dry thickness of the layer was 0.5 μm.

To the resulting polyacrylamide layer, a solution of cellulose diacetate containing palladium sulfide prepared as described below, to which 1-phenyl-2-mercaptoimidazole was added as a toning agent, was applied and dried. The dry thickness of the layer was 1.5 μm.

The solution of cellulose diacetate containing palladium sulfide was produced as follows.

To a solution prepared by dissolving 50 g of cellulose diacetate (degree of acetylation: 54%) in a mixture of 800 ml of acetone and 100 ml methanol, a solution prepared by dissolving 0.12 g of sodium sulfide ($9H_2O$) in a mixture of 15 ml of water and 35 ml of acetone and a solution prepared by dissolving 0.15 g of sodium chloropalladate in a mixture of 15 ml of water and 35 ml of acetone were added with vigorous stirring.

To the resulting cellulose diacetate layer containing palladium sulfide, an alkaline hydrolyzing solution prepared by dissolving 45 g of potassium hydroxide in a mixture of 200 ml of water and 800 ml of methanol was applied at 20 ml/m$^2$ to form a regenerated cellulose layer containing palladium sulfide.

To the resulting regenerated cellulose layer containing palladium sulfide, a copolymer of acrylic acid and butyl methacrylate (mol ratio: 85/15) containing the image stabilizing agent was applied and dried. The amount of the image stabilizing agent was adjusted so as to result in $1.0\times10^{-4}$ mol/m$^2$, respectively.

The image stabilizing agents used were as follows.

| | |
|---|---|
| Image Receiving Sheet A-1 | Compound 9 (The Present Invention) |
| Image Receiving Sheet A-2 | Compound 12 (The Present Invention) |
| Image Receiving Sheet A-3 | Compound 13 (The Present Invention) |
| Image Receiving Sheet A-4 | Compound 14 (The Present Invention) |
| Image Receiving Sheet A-5 | 1-(4-Carboxyphenyl)-2-mercaptoimidazole (Comparative Example) |
| Image Receiving Sheet A-6 | 2-(3,6,6-Trimethylheptylthio)-5-mercapto-1,3,4-thiadiazole (Comparative Example) |
| Image Receiving Sheet A-7 | No Image Stabilizing Agent (Comparative Example) (Blank) |

(2) Preparation of Light-Sensitive Layer Sheet

A gelatino silver iodobromide emulsion (iodine content: 6.5 mol%) having an average particle size of 1.0 μm was prepared by a conventional process. 100 g thereof was placed in a container and dissolved in a constant temperature bath at 50° C. To the resulting solution, 10 ml of a 1 wt% aqueous solution of 3-{5-chloro-2-[2-ethyl-3-(3-ethyl-2-benzothiazolinylidene)-propenyl]-3-benzoxazolyl}propane sulfonate, 10 ml of a 1 wt% aqueous solution of 4-{2-[3-(ethylbenzothiazolin-2-ylidene)-2-methyl-1-propenyl]-3-benzothiazolyl}propane sulfonate, 10 ml of a 1 wt% aqueous solution of 4-hydroxy-6-methyl-1,3,3a,7-tetraazaindene, 10 ml of a 1 wt% aqueous solution of 2-hydroxy-4,6-dichlorotriazine sodium salt and 10 ml of a 1 wt% aqueous solution of sodium dodecylbenzenesulfonate were added, and the mixture was stirred. The resulting emulsion was applied to a polyethylene terephthalate film base having a subbing layer containing titanium oxide so as to result in a dry film thickness of 5 microns, and dried to obtain a sample. The amount of silver applied was 1.0 g/m$^2$.

(3) Composition of Processing Solution

| | |
|---|---|
| Potassium Hydroxide (40% aq. soln. of KOH) | 323 ml |

-continued

| | |
|---|---|
| Titanium Dioxide | 3 g |
| Hydroxyethyl Cellulose | 79 g |
| Zinc Oxide | 9.75 g |
| N,N—bismethoxyethylhydroxylamine | 75 g |
| Solution of Triethanolamine (4.5 parts of triethanolamine in 6.2 parts of water) | 17.14 g |
| Tetrahydropyrimidinethione | 0.4 g |
| 2,4-Dimercaptopyrimidine | 0.35 g |
| Uracil | 80 g |
| Water | 1,193 g |

(4) Development Processing and Measurement of Density

The light-sensitive layer sheet was subjected to light wedge exposure using a densitometer having a light source of a color temperature of 5,400° K. The exposed light-sensitive layer sheet was laid on the above described image receiving sheet and the above described processing solution was spread between both sheets so as to result in a thickness of 0.05 mm to carry out diffusion transfer development. After being allowed to stand at 25° C. for 40 seconds, both sheets were separated to obtain a positive image.

Measurement was conducted using a TCD type self-recording densitometer produced by Fuji Photo Film Co., Ltd. to determine maximum density ($D_{max}$).

(5) Forced Deterioration Test (a) Forced deterioration test of undeveloped sample After an undeveloped image receiving sheet was allowed to stand for 72 hours in air at 50° C. and 80% RH or in dry air at 60° C., it was subjected to development processing in the same manner as described in above described Item (4).

(b) Forced deterioration test of transfer image

A transfer image obtained by the same development processing as described in above described Item (4) was allowed to stand for 72 hours (3 days) in air at 60° C. and 70% RH or at 40° C. and 90% RH; the fading thereof was then evaluated.

(6) Results

Image Receiving Sheets A-1 to A-7 were examined. The results thus obtained are shown together in Table 1.

In this Table, the tone of the transfer image just after development processing and after the forced deterioration test at 60° C. and 70% RH for 3 days are shown.

TABLE 1

| Image Receiving Sheet | Maximum Density ($D_{max}$) | | | | | Tone of Transfer Image | |
|---|---|---|---|---|---|---|---|
| | Just after Development Processing | Deterioration of Undeveloped Sample | | Forced Deterioration of Transfer Image | | Just after Development Processing | After fading Test at 60° C. 70% RH for 3 Days |
| | | 50° C., 80% RH for 3 Days | 60° C., Dry for 3 Days | 60° C., 70% RH for 3 Days | 40° C., 90% RH for 3 Days | | |
| A-1 (Invention) | 1.70 | 1.55 | 1.68 | 1.50 | 1.52 | Neutral gray | Neutral gray |
| A-2 (Invention) | 1.72 | 1.62 | 1.69 | 1.54 | 1.54 | " | " |
| A-3 (Invention) | 1.70 | 1.60 | 1.70 | 1.55 | 1.58 | " | " |
| A-4 (Invention) | 1.70 | 1.59 | 1.68 | 1.55 | 1.57 | " | " |
| A-5 (Comparison) | 1.24 | 1.02 | 1.13 | 1.05 | 1.07 | " | " |
| A-6 (Comparison) | 1.57 | 1.35 | 1.45 | 1.29 | 1.35 | " | " |
| A-7 (Blank) | 1.76 | 1.65 | 1.72 | 1.38 | 1.46 | " | Yellowish brown |

It is obvious that, in Image Receiving Sheets A-1, A-2, A-3 and A-4 using image stabilizing agents according to the present invention, the maximum density just after development processing is high and the reduction of the maximum density of the images by the forced deterioration test of undeveloped samples is small in comparison with comparative Image Receiving Sheets A-5 and A-6. Further, in Image Receiving Sheets A-1 to A-4, the fading of transferred images is small as compared with Image Receiving Sheet A-7 containing no image stabilizing agent (blank sample). Thus, the image stabilizing agents employed in the present invention are extremely advantageous since they improve the storage capability of formed images and image receiving sheets thereof before development processing.

EXAMPLE 2

(1) Preparation of Image Receiving Sheets B

In the same manner as described in Example 1, a mixture of a copolymer of styrene and maleic anhydride (mol ratio: 50/50) with cellulose diacetate (in a ratio of 50 wt%/50 wt%) was applied to a polyethylene laminated paper. The amount of polymers applied was 10 g/m$^2$.

To the resulting layer, a cellulose diacetate layer containing 1-(4-N-hexylcarbamoylphenyl)-2-mercaptoimidazole was applied so as to result in an amount of 5 g/m$^2$. The amount of 1-(4-N-hexylcarbamoylphenyl)-2-mercaptoimidazole was adjusted so as to result in 0.05 g/m$^2$.

To the resulting cellulose diacetate layer, a polyacrylamide layer (0.5 g/m$^2$) and a cellulose diacetate layer containing 1-phenyl-2-mercaptoimidazole (2.0 mg/m$^2$) and palladium sulfide (1.2 mg/m$^2$) as silver precipitants (1.5 g/m$^2$) were applied in this order and then an alkaline hydrolyzing solution containing potassium hydroxide was applied in the same manner as described in Example 1.

To the resulting regenerated cellulose layer containing palladium sulfide, a layer of a copolymer of acrylic acid and butyl methacrylate (mol ratio: 85/15) was applied in an amount of 7 g/m$^2$ to prepare an image receiving sheet which was designated Image Receiving Sheet B-7. To the coating solution for applying this layer, the image stabilizing agents described below were added in the form of acetone solution so as to result in an amount of $5\times10^{-4}$ mol/m$^2$ to prepare Image Receiving Sheets B-1 to B-6, respectively.

The image stabilizing agents used were as follows.

| | |
|---|---|
| Image Receiving Sheet B-1 | Compound 9 (The Present Invention) |
| Image Receiving Sheet B-2 | Compound 12 (The Present Invention) |
| Image Receiving Sheet B-3 | Compound 13 (The Present Invention) |
| Image Receiving Sheet B-4 | Compound 14 (The Present Invention) |
| Image Receiving Sheet B-5 | 1-(4-N—Hexylcarbamoylphenyl)-2-mercaptoimidazole (Comparative Example) |
| Image Receiving Sheet B-6 | 1-(4-Carboxyphenyl)-2-mercaptoimidazole (Comparative Example) |
| Image Receiving Sheet B-7 | No Image Stabilizing Agent (Blank) (Comparative Example) |

(2) Testing Condition

Using the same light-sensitive element and the same processing solution as described in Example 1, tests were carried out in the same manner as described in Example 1.

(3) Results

The results of tests thus obtained using the Image Receiving Sheets B-1 to B-7 are shown together in Table 2.

TABLE 2

| Image Receiving Sheet | Maximum Density ($D_{max}$): Just after Development Processing | Deterioration of Undeveloped Sample: 50° C., 80% RH for 3 Days | Deterioration of Undeveloped Sample: 60° C., Dry for 3 Days | Forced Deterioration of Transfer Image: 60° C., 70% RH for 3 Days | Forced Deterioration of Transfer Image: 40° C., 90% RH for 3 Days | Tone of Transfer Image: Just after Development Processing | Tone of Transfer Image: After Fading Test at 60° C. 70% RH for 3 Days |
|---|---|---|---|---|---|---|---|
| B-1 (Invention) | 1.72 | 1.62 | 1.68 | 1.54 | 1.58 | Neutral gray | Neutral gray |
| B-2 (Invention) | 1.74 | 1.62 | 1.69 | 1.53 | 1.58 | " | " |
| B-3 (Invention) | 1.74 | 1.63 | 1.70 | 1.57 | 1.61 | " | " |
| B-4 (Invention) | 1.73 | 1.64 | 1.69 | 1.56 | 1.60 | " | " |
| B-5 (Comparison) | 1.64 | 1.48 | 1.53 | 1.54 | 1.56 | " | " |
| B-6 (Comparison) | 1.60 | 1.40 | 1.49 | 1.50 | 1.52 | " | " |
| B-7 (Blank) | 1.76 | 1.65 | 1.70 | 1.48 | 1.50 | " | Blackish brown |

It is clear that with Image Receiving Sheets B-1 to B-4 using the image stabilizing agents according to the present invention, the reduction of the maximum density of the image just after development processing is small in comparison with comparative Image Receiving Sheets B-5 and B-6 and the reduction of maximum density by the forced deterioration of the transfer image is small as compared with Image Receiving Sheet B-7 wherein 1-(4-N-hexylcarbamoylphenyl)-2-mercaptoimidazole is employed alone. Thus, it is apparent that the image stabilizing agents according to the present invention have an excellent image stabilizing effect.

EXAMPLE 3

(1) Preparation of Image Receiving Sheets C

In the same manner as described in Example 1, a mixture of a copolymer of methyl vinyl ether and maleic anhydride (mol ratio: 50/50) with cellulose diacetate (in a ratio of 40 wt%/60 wt%) was applied to a polyethylene laminated paper. The amount of polymers applied was 10 g/m$^2$.

To the resulting layer, a cellulose diacetate layer containing the image stabilizing agent described below was applied so as to result in 4 g/m$^2$. The amount of the image stabilizing agent was adjusted so as to result in $2.5\times10^{-3}$ mol/m$^2$.

The image stabilizing agents used were as follows.

| | |
|---|---|
| Image Receiving Sheet C-1 | Compound 9 (The Present Invention) |
| Image Receiving Sheet C-2 | Compound 10 (The Present Invention) |
| Image Receiving Sheet C-3 | Compound 11 (The Present Invention) |
| Image Receiving Sheet C-4 | Compound 13 (The Present Invention) |
| Image Receiving Sheet C-5 | Compound 14 (The Present Invention) |
| Image Receiving Sheet C-6 | 1-Phenyl-2-mercaptoimidazole (Comparative Example) |
| Image Receiving Sheet C-7 | 1-(4-Carboxyphenyl)-2-mercaptoimidazole (Comparative Example) |
| Image Receiving Sheet C-8 | No Image Stabilizing Agent (Blank) (Comparative Example) |

To the resulting cellulose diacetate layer containing the image stabilizing agent there was applied an aqueous solution of gum arabic so as to result in a dry thickness of 0.5 μm and then a cellulose diacetate layer containing 1-phenyl-2-mercaptoimidazole as a toning agent was applied so as to result in a dry thickness of 2 μm. The amount of 1-phenyl-2-mercaptoimidazole applied was $5\times10^{-4}$ mol/m$^2$.

To the polyethylene laminated paper containing a cellulose diacetate layer prepared as described above, the following alkaline hydrolyzing solution containing silver precipitants was applied in an amount of 30 ml/m$^2$ to produce Image Receiving Sheets C-1 to C-8 for use in a diffusion transfer process.

The alkaline hydrolyzing solution used was prepared as follows.

0.7 g of nickel nitrate was dissolved in 7 ml of water, and 100 g of glycerin was added to the resulting solution. To the solution, a solution prepared by dissolving 5 g of sodium sulfide in 5 ml of water was added with vigorous stirring to produce a silver precipitant dispersion containing nickel sulfide.

To a solution prepared by dissolving 55 g of sodium hydroxide in a mixture of 300 ml of water and 1,200 ml of methanol, 40 g of the above described silver precipitant dispersion was added.

(2) Testing Conditions

Using the same light-sensitive element and the same processing solution as described in Example 1, tests were carried out in the same manner as described in Example 1.

(3) Results

The results of tests thus obtained using the Image Receiving Sheets C-1 to C-8 are shown in Table 3.

TABLE 3

| Image Receiving Sheet | Maximum Density ($D_{max}$) Just after Development Processing | Deterioration of Undeveloped Sample 50° C., 80% RH for 3 Days | Deterioration of Undeveloped Sample 60° C., Dry for 3 Days | Forced Deterioration of Transfer Image 60° C., 70% RH for 3 Days | Forced Deterioration of Transfer Image 40° C., 90% RH for 3 Days | Tone of Transfer Image Just after Development Processing | Tone of Transfer Image After Fading Test at 60° C. 70% RH for 3 Days |
|---|---|---|---|---|---|---|---|
| C-1 (Invention) | 1.80 | 1.76 | 1.76 | 1.52 | 1.56 | Neutral gray | Almost neutral gray |
| C-2 (Invention) | 1.77 | 1.77 | 1.74 | 1.50 | 1.55 | " | " |
| C-3 (Invention) | 1.78 | 1.76 | 1.77 | 1.50 | 1.54 | " | " |
| C-4 (Invention) | 1.78 | 1.74 | 1.71 | 1.62 | 1.64 | " | " |
| C-5 (Invention) | 1.78 | 1.74 | 1.70 | 1.62 | 1.64 | " | Neutral gray |
| C-6 (Comparison) | 1.51 | 1.27 | 1.46 | 1.31 | 1.35 | " | " |
| C-7 (Comparison) | 1.56 | 1.30 | 1.44 | 1.35 | 1.40 | " | Blackish brown |
| C-8 (Blank) | 1.85 | 1.78 | 1.80 | 1.39 | 1.50 | " | Yellowish brown |

It is clear that with Image Receiving Sheets C-1 to C-5 using the image stabilizing agents according to the present invention, the maximum density just after development processing is high and the reduction of maximum density by forced deterioration of an undeveloped sample is small in comparison with comparative Image Receiving Sheets C-6 and C-7. Further, in Image Receiving Sheets C-1 to C-5, the images are clearly stable, as compared with Image Receiving Sheet C-8 (blank sample). Thus, it is apparent that the image stabilizing agents according to the present invention exhibit excellent properties.

While the invention has been described in detail and with reference to specific embodiments thereof, it will be apparent to one skilled in the art that various changes and modifications can be made therein without departing from the spirit and scope thereof.

What is claimed is:

1. In a photographic element for a silver salt diffusion transfer process comprising a silver halide light-sensitive element, an image receiving element and a processing element, the improvement wherein the photographic element contains at least one image stabilizing agent represented by the following general formula (I) or (II)

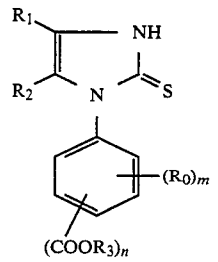

(I)

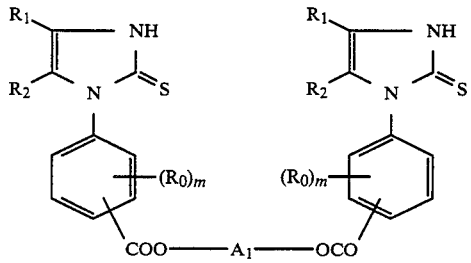

(II)

wherein the $R_0$ groups, which may be the same or different, each represents a hydrogen atom, a halogen atom, an unsubstituted or substituted alkyl group, an unsubstituted or substituted cycloalkyl group, an unsubstituted or substituted alkoxy group, an unsubstituted or substituted alkylsulfonyl group, an unsubstituted or substituted arylsulfonyl group, a sulfamoyl group, an alkyl sulfoamido group, an arylsulfoamido group, a carbamoyl group, a carbonamido group, a heterocyclic group, an unsubstituted or substituted aryl group, an acyl group, an unsubstituted or substituted alkoxycarbonyl group, or an unsubstituted or substituted acyloxy group, an unsubstituted or substituted alkylthio group, an unsubstituted or substituted arylthio group, a primary amino group or a salt thereof, a secondary or tertiary amino group substituted with an alkyl group or an aryl group or the salt thereof, a nitro group, hydroxyl group, a carboxyl group, a sulfonic acid group or a cyano group; $R_1$ and $R_2$ each represents a hydrogen atom, a halogen atom, un unsubstituted or substituted alkyl group or an aryl group; $R_3$ represents an unsubstituted or substituted alkyl group; an unsubstituted or substituted aryl group or a heterocyclic group; $A_1$ represents a divalent group; m represents an integer of 1 to 4, and n represents an integer of 1 or 2.

2. A photographic element as claimed in claim 1, wherein the compound represented by general formula (I) is

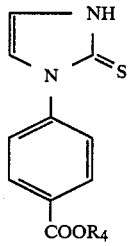

wherein $R_4$ represents an alkyl group having from 1 to 30 carbon atoms or a substituted alkyl group having from 1 to 30 carbon atoms in the alkyl moiety.

3. A photographic element as claimed in claim 2, wherein $R_4$ is a butyl group, a pentyl group, a hexyl group, a heptyl group, an octyl group, a decyl group, a dodecyl group, a tetradecyl group, a hexadecyl group or an octadecyl group.

4. A photographic element as claimed in claim 1, wherein the compound represented by general formula (II) is

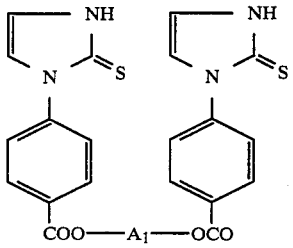

wherein $A_1$ represents an alkylene group having from 2 to 8 carbon atoms.

5. A photographic element as claimed in claim 4, wherein $A_1$ is an ethylene group, a propylene group, a butylene group, a pentylene group, a heptylene group or an octylene group.

6. A photographic element as claimed in claim 1, wherein the compound represented by general formula (I) or (II) is contained in the image receiving element.

7. A photographic element as claimed in claim 1, wherein the image receiving element comprises an image receiving layer containing a silver precipitant.

8. A photographic element as claimed in claim 7, wherein the image receiving layer comprises a binder which is regenerated cellulose.

9. A photographic element as claimed in claim 7, wherein the compound represented by general formula (I) or (II) is added to a layer under the image receiving layer of the image receiving element.

10. A photographic element as claimed in claim 9, wherein the layer containing the compound represented by general formula (I) or (II) of the image receiving element comprises a binder which is a polymer of 2-hydroxyethyl methacrylate.

11. A photographic element as claimed in claim 7, wherein the image receiving element comprises a layer of acid polymer.

12. A photographic element as claimed in claim 11, wherein the compound represented by general formula (I) or (II) is contained in the layer of the acid polymer of the image receiving element.

13. A photographic element as claimed in claim 6, wherein the compund represented by general formula (I) or (II) is contained in a layer of the image receiving element which contains a silver precipitant.

14. A photographic element as claimed in claim 6, wherein the compound represented by general formula (I) in the image receiving element is

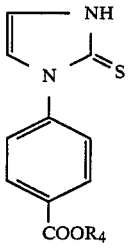

wherein $R_4$ represents an alkyl group having from 1 to 30 carbon atoms or a substituted alkyl group having from 1 to 30 carbon atoms in the alkyl moiety.

15. A photographic element as claimed in claim 14, wherein $R_4$ is a butyl group, a pentyl group, a hexyl group, a heptyl group, an octyl group, a decyl group, a dodecyl group, a tetradecyl group, a hexadecyl group or an octadecyl group.

16. A photographic element as claimed in claim 6, wherein the compound represented by general formula (II) in the image receiving element is

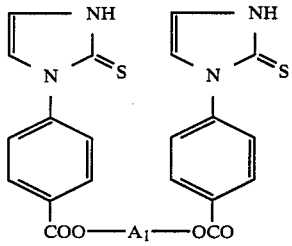

wherein $A_1$ represents an alkylene group having from 2 to 8 carbon atoms.

17. A photographic element as claimed in claim 16, wherein $A_1$ is an ethylene group, a propylene group, a butylene group, a pentylene group, a heptylene group or an octylene group.

18. A photographic element as claimed in claim 1, wherein the photographic element for silver salt diffusion transfer process is characterized in that transfer silver images are obtained by laying a light-sensitive material, wherein, the light-sensitive element containing a silver halide photographic emulsion is applied to a support, on the image receiving material wherein the image receiving element which contains silver precipitants is applied to another support, and spreading an alkali processing composition as the processing element between the light-sensitive material and the image receiving material.

19. A photographic element as claimed in claim 18, wherein the support of the image receiving element is polyethylene laminated paper.

20. A photographic element as claimed in claim 19, wherein the image receiving element has an acid polymer layer which reduces the pH of the image receiving element after development processing and a neutralization timing layer which controls the timing of neutralization.

21. A photographic element as claimed in claim 20, wherein the neutralization timing layer comprises acetyl cellulose.

22. A photographic element as claimed in claim 18, wherein the layer construction of the image receiving element comprises, in the order listed, an acid polymer layer, a neutralization timing layer, and an image receiving layer containing silver precipitants, which are provided on a support.

23. A photographic element as claimed in claim 18, wherein the layer construction of the image receiving element comprises, in the order listed, an acid polymer layer, a neutralization timing layer, a hydrophilic polymer layer, and an image receiving layer containing silver precipitants, which are provided on a support.

24. A photographic element as claimed in claim 22, wherein the compound represented by general formula (I) or (II) is added to both the image receiving layer and another layer.

25. A photographic element as claimed in claim 23, wherein the compound represented by general formula (I) or (II) is added to both the image receiving layer and another layer.

26. A photographic element as claimed in claim 6, wherein the image receiving element contains the compound represented by general formula (I) or (II) and a water-soluble heavy metal salt.

27. A photographic element as claimed in claim 26, wherein the heavy metal salt is chloroaurate.

28. A photographic element as claimed in claim 1, wherein the concentration of the compound represented by general formula (I) or (II) is in the range of from about $1\times10^{-6}$ to $1{,}000\times10^{-6}$ mol/m$^2$.

29. A photographic element as claimed in claim 1, wherein the concentration of the compound represented by general formula (I) or (II) is in the range of from $10\times10^{-6}$ to $500\times10^{-6}$ mol/m$^2$.

* * * * *